US006481029B1

(12) United States Patent
Mateina

(10) Patent No.: US 6,481,029 B1
(45) Date of Patent: Nov. 19, 2002

(54) SANITARY DEVICE

(75) Inventor: Ludger Mateina, Ahlen (DE)

(73) Assignee: Franz Kaldewei GmbH & Co., Ahlen (DE)

( * ) Notice: Subject to any disclaimer, the term of this patent is extended or adjusted under 35 U.S.C. 154(b) by 0 days.

(21) Appl. No.: 09/687,850

(22) Filed: Oct. 13, 2000

(30) Foreign Application Priority Data

Oct. 22, 1999 (EP) ..... 99121124

(51) Int. Cl.[7] ..... A47K 3/00
(52) U.S. Cl. ..... 4/592; 4/584
(58) Field of Search ..... 4/538, 541.1, 541.2, 4/567, 568, 570, 546, 559, 584, 592, 594, 677, 676, 675, 638

(56) References Cited

U.S. PATENT DOCUMENTS

| | | | | | |
|---|---|---|---|---|---|
| 3,886,936 | A | * | 6/1975 | Wehrenberg | 128/66 |
| 4,756,030 | A | * | 7/1988 | Juliver | 4/192 |
| 4,941,608 | A | * | 7/1990 | Shimizu et al. | 236/12.12 |
| 5,058,804 | A | * | 10/1991 | Yonekubo et al. | 236/12.12 |
| 5,351,345 | A | * | 10/1994 | Sills et al. | 4/555 |
| 5,491,849 | A | * | 2/1996 | Colussi et al. | 4/559 |
| 5,604,940 | A | * | 2/1997 | Shimizu | 4/541.1 |
| 6,243,889 | B1 | * | 6/2001 | Ducharme et al. | 4/545 |

FOREIGN PATENT DOCUMENTS

| | | | |
|---|---|---|---|
| DE | 3320617 | A1 * | 7/1984 |
| DE | 3616421 | A1 * | 11/1987 |
| DE | 42 39 801 | | 6/1993 |
| DE | 19649161 | A1 * | 7/1997 |
| DE | 10029759 | A1 * | 9/2001 |
| EP | 0 283 816 | | 9/1988 |
| GB | 1 424 423 | | 2/1976 |
| GB | 2 075 339 | | 11/1981 |
| GB | 2 174 219 | | 10/1986 |
| GB | 2 242 758 | | 10/1991 |

* cited by examiner

*Primary Examiner*—Timothy L. Maust
*Assistant Examiner*—Huyen Le
(74) *Attorney, Agent, or Firm*—Collard & Roe, P.C.

(57) ABSTRACT

A sanitary device comprises a bathtub arranged on feet, a bathtub encasement, a set of fittings for the water inlet, the water overflow and the water drain, a handheld shower head held on the ledge of the bathtub, and a mixing fitting for cold and hot water. The mixing fitting has connections on the inlet side for cold and hot water. Connections of the fitting on the outlet side are connected with the water inlet for the set of fittings and the handheld shower head. The mixing fitting is arranged within the space enclosed by the tub encasement. The mixing fitting has electrically actuated adjusting devices with an associated electronic control that can be controlled by means of an input/output device arranged on the ledge of the tub.

8 Claims, 4 Drawing Sheets

SANITARY DEVICE

BACKGROUND OF THE INVENTION

1. Field of the Invention

The present invention relates to a sanitary device comprising a bathtub arranged on feet; an encasing of the bathtub; a set of bathtub fittings for the water inlet, the water overflow and the water drain; a handheld shower head; and a mixing fitting. The mixing fitting has connections on the inlet side for cold and hot water. On the outlet side, the mixing fitting has connections connected with the water inlet of the bathtub fittings set and the hand-held shower head.

2. The Prior Art

In practice, the individual components of a sanitary device are mounted at the site of installation. Much expenditure in time and effort is required for the connections to the pipelines available on the side of the building for cold and hot water; the connection of the hand-held shower head; and the installation of the set of bathtub fittings for the water inlet, the water overflow and the water drain, with the associated pipeline system. Furthermore, the visible arrangement of the mixing fitting, for example on the ledge of the bathtub, is an unsatisfactory design.

It is known from DE-A 42 39 801 to accommodate the mechanical part of a manual lever mixer in an open-top housing that is inserted in the ledge of a tub. The arrangement is suitable for a sink for washing the hands, with a wide edge of the sink. The possibilities for arranging the mechanical part on a bathtub, however, are limited. In bathtubs, a projecting manual lever is sometimes considered annoying both aesthetically and functionally, particularly considering that with standard equipment of this type, the design of the hand lever is not adapted to the furnishings of the bathroom.

The invention addresses the problem of proposing a sanitary device that is mobile, assembled ready for connection and fully functioning, and whose mixing fitting is not visually apparent.

SUMMARY OF THE INVENTION

In accordance with the invention, this problem is solved for a sanitary device having the structure described above by arranging the mixing fitting within a space enclosed by the encasement of the tub and by providing the device with electrically actuated adjusting devices and an associated electronic control controlled by an input/output device arranged on the ledge of the tub.

The bathtub encasement is preferably structured from molded components made of a hard-adjusted integral foam material. For installation purposes, the unit can be removed at the site of installation from the wall of the bathroom, where it can be positioned in a suitable manner. The ledge of the tub rests on the board-like molded components. These components secure the tub against tilting movements when the ledge is loaded. The hard foam boards support a decorative covering such as, for example a foil coating. A substantial hollow space remains between the bathtub encasement and the bathtub. This hollow space can be used for installing the mixing fitting. Preferably the mixing fitting is accessible through a cutout in a side wall of the tub encasement that is situated adjacent to the wall of the room. Through this cutout can also be installed connection hoses connecting the connections available on the building side for hot and cold water with the respective connections on the mixing fitting. The mixing fitting, along with its adjusting devices and control electronics, is preferably accommodated in a connection box arranged near the floor, or on the back side of the tub.

The mixing fitting has at least one electrically actuated shutoff and control valve, and it is usefully equipped with a temperature controller as well. Furthermore, the mixing fitting may comprise devices for measuring the temperature and/or the volume of the flow-through.

The input/output device has sensors for inputting preset values for the water temperature and/or the tub filling quantity and/or the clock time needed for filling the tub, and it is preferably equipped with a device for displaying the adjusted values as well. It is understood that the sensors and other devices are protected against wetness, for example by means of a plastic sheet cover. According to a preferred embodiment of the invention, the adjusted values can be stored and called off by means of a memory key. This permits presetting adjustments that are person-specific. A receiver for wireless signal transmission may be associated with the electronic control as well.

In a further embodiment, the mixing fitting may include additional connections for pipelines that can be connected to other sanitary devices, for example to an adjacent shower, an adjacent sink for washing the hands and the like. To that extent the mixing fitting performs the function of a central fitting that can be controlled via one or several input/output devices. For controlling several input/output devices, the mixing fitting is usefully equipped with multi-way valves that can be actuated electronically, the valves being connected to the electronic control as well.

BRIEF DESCRIPTION OF THE DRAWINGS

The invention is explained in the following description with the help of the drawings showing an exemplified embodiment, in which.

DETAILED DESCRIPTION OF THE PREFERRED EMBODIMENT

Figure 1:
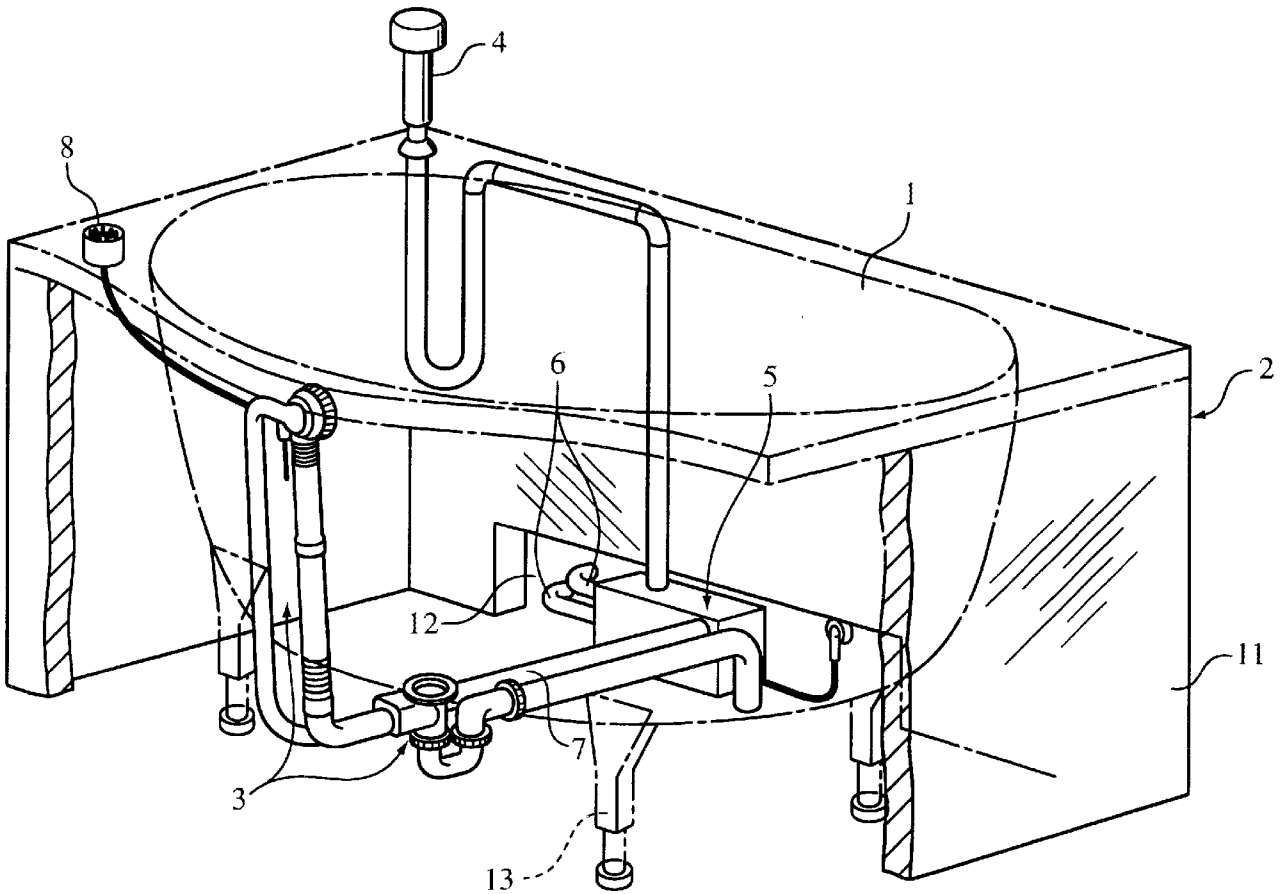
FIG. 1 is a perspective representation of the structure of a sanitary device as defined by the invention.

The basic structure of the sanitary device shown in FIG. 1 comprises a bathtub 1 arranged on feet 13, an encasement 2, a set 3 for the water inlet, the water overflow and the water drain, and a handheld shower head 4 supported on the ledge of bathtub 1. A mixing fitting 5 is arranged within the space encased by the tub encasement 2. In the exemplified embodiment, the mixing fitting is accommodated in a connection box 15 near the floor. As shown in FIG. 1, connections 6 are provided for cold and hot water and connections 7 are provided on the outlet side for the fitting. The connections are connected with the water inlet of the set 3 of fittings and handheld shower head 4.

Figure 2:
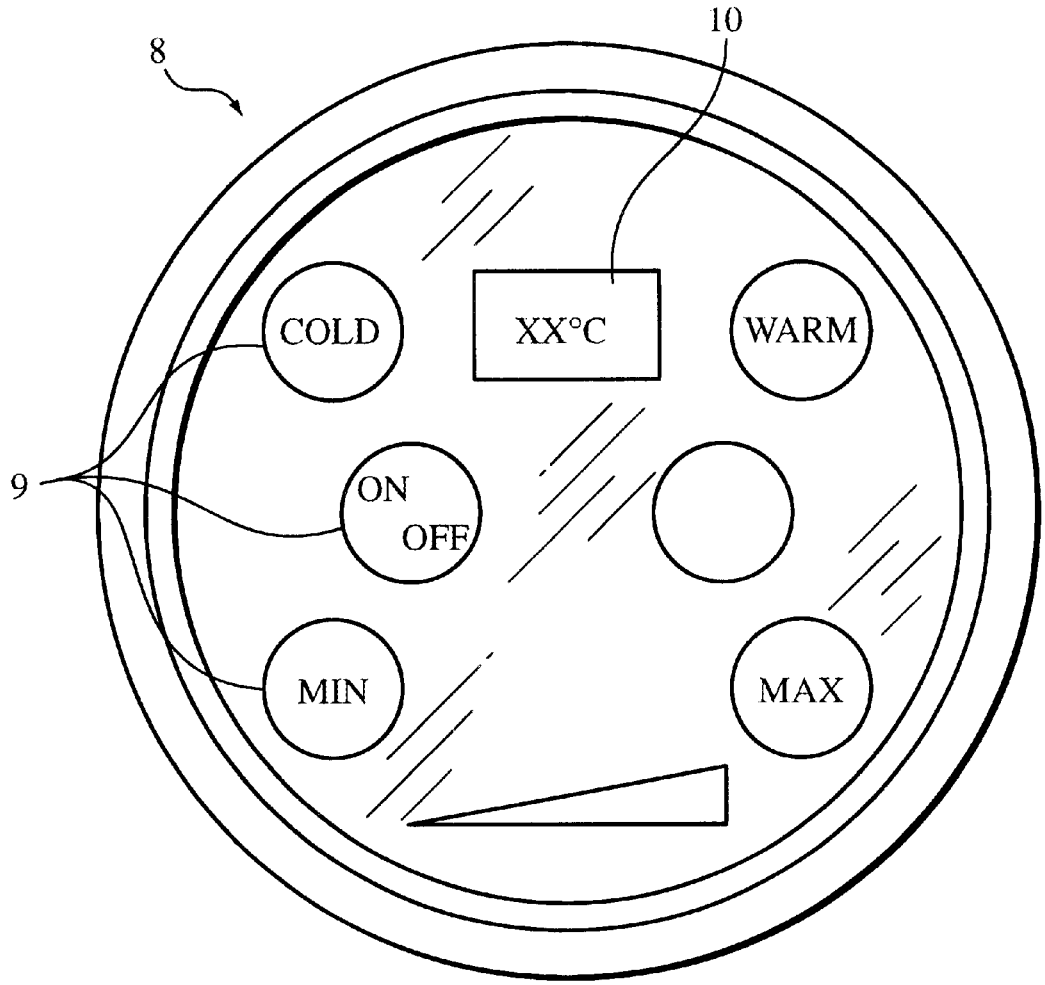
FIG. 2 is a top view of an input/output device for controlling a mixing fitting of the sanitary device shown in FIG. 1.
Figure 3:
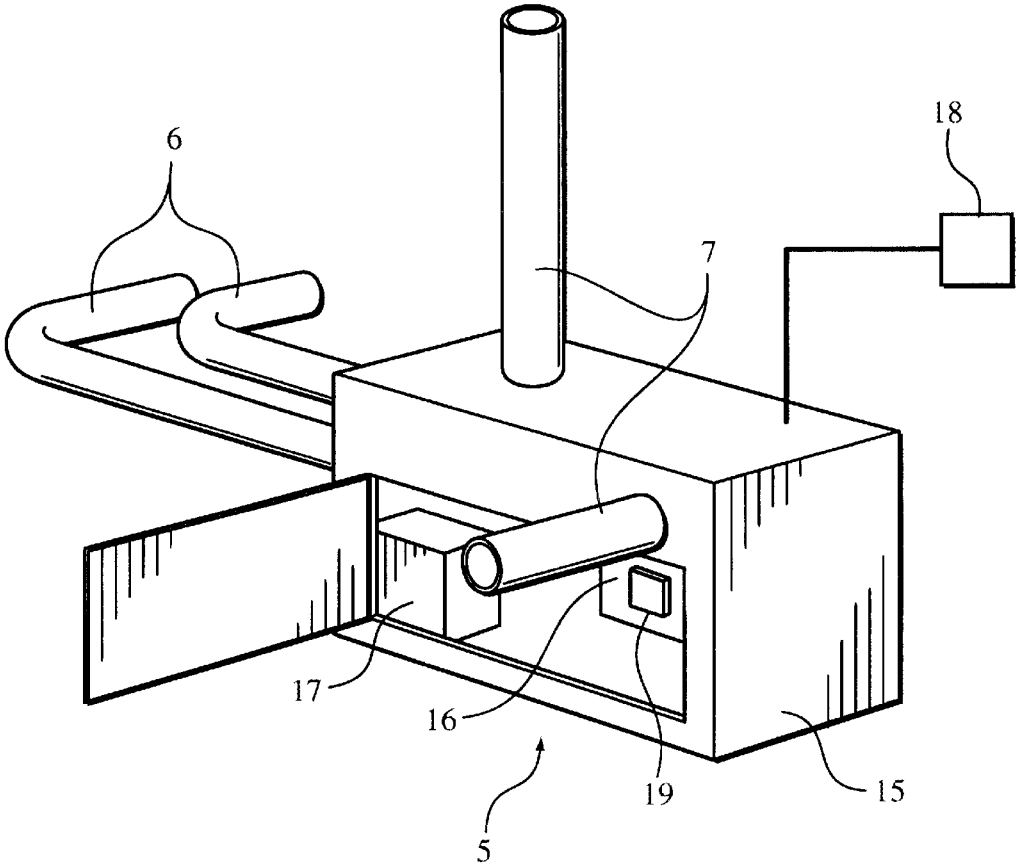
FIG. 3 is a schematic representation of the structure of the mixing fitting.
Figure 4:
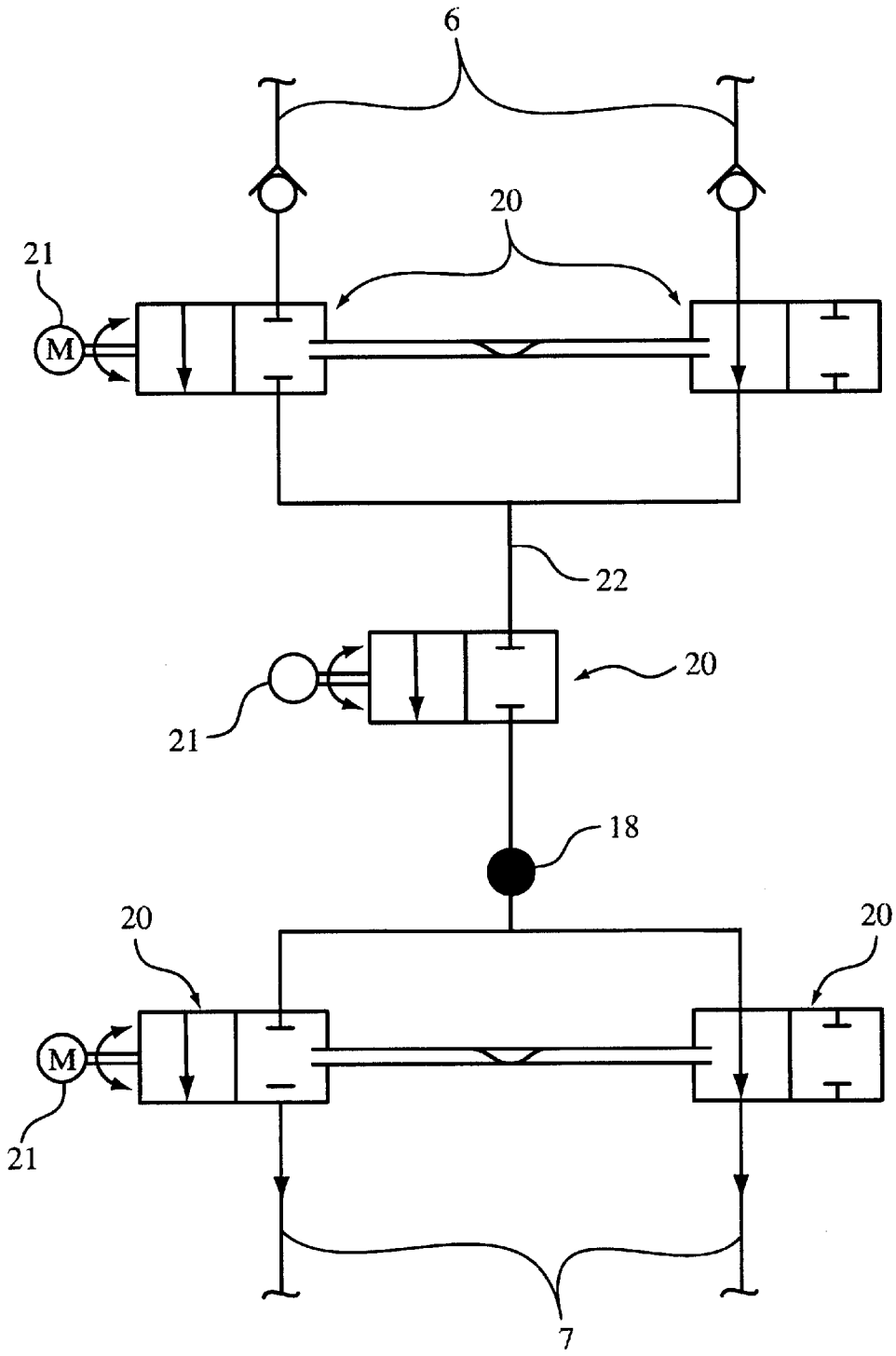
FIG. 4 is a functional circuit diagram of the mixing fitting.

Mixing fitting 5 has electrically actuated adjusting devices in the form of rotary valves 20, which are equipped with servo-drives 21, and an electronic control 16, associated with the adjusting devices. A receiver 19 for wireless signal transmission may be associated with electronic control 16. The electronic control can be controlled by an input/output device 8 arranged on the ledge of the tub. The input/output device 8 is equipped with sensor keys 9 for switching on and off, as well as for inputting preset values for the water temperature and the volume of water through-put (FIG. 2). It may be equipped with additional keys for inputting preset values for the filling quantity and/or the clock time for a tub filling. Furthermore, one or several memory keys may be provided to store and deactivate adjusted values for these parameters. In addition, the input/output device 8 is usefully equipped with a display device 10 for displaying the adjusted values.

Mixing fitting 5 has at least one electrically actuated shutoff and control valve 20 accommodated in valve block 17. It is usefully equipped with a temperature controller (the two rotary valves on the inlet side which control the temperature of the water in mixed water channel 22) as well as with devices for measuring the temperature 18 and/or the volume of through-put.

The encasement 2 is structured from molded components 11 consisting of a hard-adjusted polyurethane integral foam material, the components being assembled to form a supporting construction unit. The encasement consisting of the molded components 11 supports the bathtub against tilting and form with the bathtub a mobile unit. The molded components 11 take the form of molded boards and are covered with a decorative foil material. The integral foam material has a density of between 200 and 800 kg/cubic meter, preferably of between 200 and 500 kg/cubic meter. The side wall adjacent to the wall of the room, which is the rear wall in FIG. 1, has a cutout 12 through which mixing fitting 5 is accessible. Connections 7 of the mixing fitting for cold and hot water on the inlet side are connected by flexible hoses with installations on the building side. Such connections can take the form of plug connections, for example. The result is to that extent a sanitary device that is ready to be plugged in.

Accordingly, while a few embodiments of the present invention have been shown and described, it is to be understood that many changes and modifications may be made thereunto without departing from the spirit and scope of the invention as defined in the appended claims.

What is claimed is:

1. A mobile sanitary device that is assembled ready for connection and fully functioning comprising:

(a) a bathtub arranged on feet having a ledge;

(b) an encasement enclosing a space, wherein the tub encasement is assembled from molded boards consisting of a hard-adjusted polyurethane-integral foam material and being laminated with a decorative foil material, the assembled boards forming a supporting construction unit, and wherein the ledge of the tub rests on the molded boards;

(c) a fittings set comprising a water inlet, a water overflow, and a water drain connected to the bathtub;

(d) a shower head supported on the ledge of the bathtub;

(e) a mixing fitting arranged within the space enclosed by the tub encasement in proximity to a floor of a room and being accessible through a cutout in a side wall of the encasement that is situated to a wall of the room, the mixing fitting having an inlet side, an outlet side, inlet side connections for cold and hot water, outlet side connections connected with the water inlet and the shower head, electrically actuated adjusting devices, and an electronic control for the adjusting devices; and (f) an input/output device controlling the control arranged on the ledge of the bathtub.

2. The sanitary device according to claim 1 further comprising a connection box accommodating the mixing fitting, the adjusting devices and the electronic control.

3. The sanitary device according to claim 1, wherein the mixing fitting has at least one electrically actuated shutoff and control valve.

4. The sanitary device according to claim 1, wherein the mixing fitting is equipped with a temperature controller.

5. The sanitary device according to claim 1, wherein the mixing fitting is equipped with devices for measuring the temperature or the volume of flow-through.

6. The sanitary device according to claim 1, wherein the input/output device has sensor keys for inputting adjustable preset values selected from the group consisting of water temperature values, filling quantity values, and clock time values for filling the tub, and a display device for displaying the values.

7. The sanitary device according to claim 6, wherein the values can be stored and called off by means of a memory key.

8. The sanitary device according to claim 1, further comprising a receiver designed for wireless signal transmission associated with the electronic control.

* * * * *